US006070598A

United States Patent [19]

Gueret

[11] Patent Number: 6,070,598

[45] Date of Patent: Jun. 6, 2000

[54] DEVICE FOR MAKING UP THE LIPS OR THE EYELIDS, AND AN APPLICATOR

[75] Inventor: Jean-Louis Gueret, Paris, France

[73] Assignee: L'Oreal, Paris, France

[21] Appl. No.: 09/333,953

[22] Filed: Jun. 16, 1999

[30] Foreign Application Priority Data

Jun. 17, 1998 [FR] France ..... 98 07634

[51] Int. Cl.[7] ..... A45D 40/26

[52] U.S. Cl. ..... 132/320; 132/317; 132/318

[58] Field of Search ..... 132/218, 317, 132/318, 320; 401/119, 122, 126, 129, 128, 130

[56] References Cited

U.S. PATENT DOCUMENTS

| | | | |
|---|---|---|---|
| 1,576,567 | 3/1926 | Buhl-Bonanno | 132/318 |
| 2,007,245 | 7/1935 | Gimonet | 132/318 |
| 4,404,977 | 9/1983 | Vasas | 132/218 |
| 4,740,097 | 4/1988 | Kapustin | 132/318 |
| 5,224,787 | 7/1993 | Vasas | 401/119 |

FOREIGN PATENT DOCUMENTS

| | | | |
|---|---|---|---|
| 2285101 | 4/1976 | France | 132/320 |
| 2146520 | 4/1985 | United Kingdom | 132/218 |

*Primary Examiner*—John J. Wilson
*Assistant Examiner*—Pedro Philogene
*Attorney, Agent, or Firm*—Oliff & Berridge, PLC

[57] ABSTRACT

A device for making up the lips or the eyelids, the device comprising a container containing the cosmetic to be applied, an applicator including an applicator element, and a wiper member through which the applicator element is extracted from the container. At least while the applicator element is passing through the wiper member, the applicator element and the wiper member present sections that are different so that the wiper member does not come into wiping contact with all of the side surface of the applicator element, and some cosmetic remains thereon after it has passed through the wiper member.

32 Claims, 6 Drawing Sheets

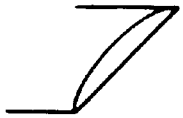
FIG_14
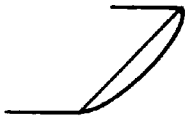
FIG_15
FIG_16
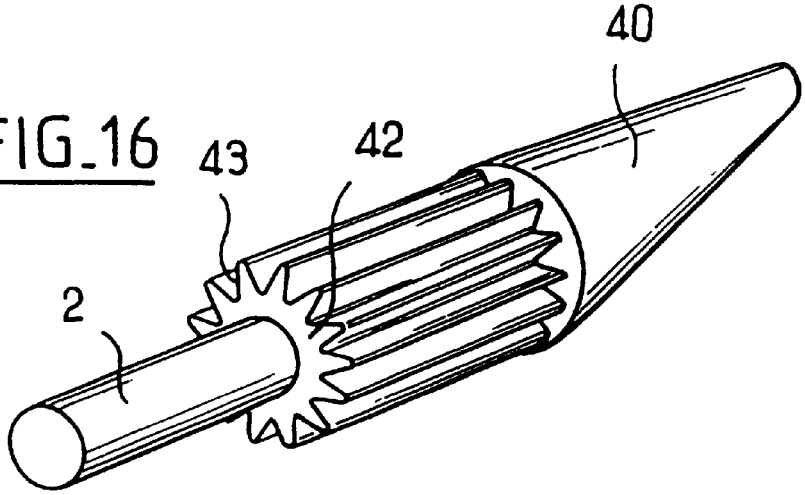
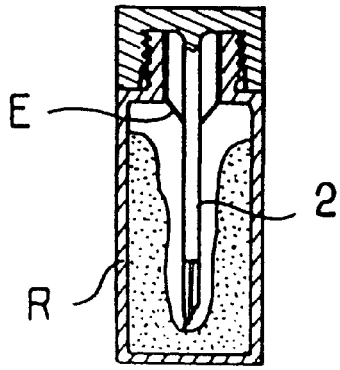
FIG_17

DEVICE FOR MAKING UP THE LIPS OR THE EYELIDS, AND AN APPLICATOR

The present invention relates to applying a cosmetic.

BACKGROUND OF THE INVENTION

For the purpose of making up the lips or the eyelids, it is known to use an applicator comprising an applicator element whose free end forms a chamfer and whose side surface is circularly cylindrical.

To apply the cosmetic, the applicator element is wiped by means of a wiper member constituted by an annular lip whose radially inner edge is circular and presents a diameter corresponding to the diameter of the side surface of the applicator element, such that, after wiping, the cosmetic available for making up is present solely on the chamfer of the applicator.

Such an applicator does not provide complete satisfaction, in particular for the following reasons.

Firstly, when the applicator is withdrawn through the wiper member, a piston phenomenon occurs, i.e. suction is established in the container containing the supply of cosmetic.

A consequence of this suction is that when the wiper member reaches the chamfer of the applicator and the container returns suddenly to atmospheric pressure, the inrush of air projects cosmetic that has accumulated on the wiper member at the chamfer of the applicator.

As a result, the quantity of cosmetic present on the applicator varies from one application to another and the cosmetic tends to be provided in excess and to be distributed in non-uniform manner on the chamfer of the applicator, which spoils the quality of the makeup.

Secondly, cosmetic is applied over a large area by moving the chamfer of the applicator flat over the skin.

Makeup is thus pushed to the sides of the applicator and forms furrows that spoil the quality of the makeup.

OBJECTS AND SUMMARY OF THE INVENTION

An object of the present invention is to provide a novel device of greater performance, for the purpose of making up the lips or the eyelids, the device being of the type comprising a container containing the cosmetic to be applied, an applicator having an applicator element, and a wiper member through which the applicator element is extracted from the container.

In the device, at least while the applicator element is passing through the wiper member, the applicator element and the wiper member present sections that are different so that the wiper member does not come into wiping contact with all of the side surface of the applicator element, and some cosmetic remains thereon after it has passed through the wiper member.

Preferably, the side surface of the applicator element is not a circular cylinder and has at least one depression.

Thus, the entire side surface of the applicator element is not wiped by the wiper member and a supply of cosmetic remains that can be used for making up a large area.

By means of the invention, the free end of the applicator element can then be used solely for the purpose of outlining the lips or the eyelids.

In addition, the side surface of the applicator element makes it possible to recover excess cosmetic left on the skin and to smooth the layer of cosmetic that has been deposited so that making up is performed with a relatively uniform thickness of cosmetic and without any furrows being formed.

The applicator thus lasts for longer because it is possible to use cosmetic present on the side surface of the applicator for makeup purposes instead of being restricted to using only the cosmetic that is present on the free end thereof.

The wiper member can be constituted by an annular lip whose radially inner edge is circular.

The wiper member may also include a block of foam.

Preferably, the side surface of the applicator element is continuous, i.e. the depression(s) formed in the side surface of the applicator is/are relatively shallow, the depth thereof preferably not exceeding one-fourth of the outside diameter of the applicator element.

When the wiper member includes foam, the foam should be hard enough to avoid fitting closely to the outline of the side surface of the applicator element, so that it does not wipe it completely.

The shape given to the side surface of the applicator element also makes it possible to reduce or even eliminate the "pistoning" phenomenon that occurs while the applicator is being withdrawn, by allowing air or cosmetic to flow along the applicator element as it passes through the wiper member, thereby ensuring that excessive suction is not created within the container.

The free end of the applicator element and the depression (s) present in its side surface can be given shapes and surface appearance that make it possible to obtain the looked-for makeup effect to be obtained, depending on the nature and the consistency of the cosmetic used, which cosmetic can be a liquid of greater or smaller viscosity, or a gel, for example.

In a particular embodiment, the side surface of the applicator element includes a crisscross configuration.

In a particular embodiment, the side surface of the applicator element includes ring-shaped depressions.

In a preferred implementation of the invention, the general shape of the free end of the applicator element is obtained by molding a plastics material, e.g. an elastomer.

In a particular embodiment, the free end of the applicator element forms a point or a chamfer, the point being pyramid-shaped, or conical, or in the form of two chamfers.

Still in a particular embodiment, the side surface of the applicator element has a plurality of longitudinally-extending depressions which, after wiping, contain a predetermined quantity of cosmetic.

Still in a particular embodiment, the side surface of the applicator element has at least one depression that opens out to its free end.

Preferably, when the wiper member is an annular lip, the side surface of the applicator element has a cross-section with lobes whose ridges are circumscribed by the radially inner edge of the lip.

The side surface of the applicator element may also have at least one depression that terminates at a distance from its free end, preferably at a distance of at least 1 mm.

When the side surface of the applicator element has a plurality of depressions, the depressions are preferably separated by longitudinal ribs, which ribs advantageously present a cross-section of outwardly convex rounded profile.

The number of the above-mentioned depressions can be two, four, or six, for example, and they are preferably disposed in such a manner to present substantially axial symmetry.

When the free end of the applicator element is chamfered in shape, then the chamfer advantageously makes an angle lying in the range 15° to 45° and preferably equal to 30°, relative to the longitudinal axis of the applicator.

Preferably, the side surface of the applicator element includes at least two depressions that are separated by at least two ribs whose ridges lie in a plane containing the longitudinal axis of the applicator and also the leading edge of the chamfered end.

In a particular embodiment, the applicator element has at least one depression made by means of a fitted part, e.g. constituted by a sleeve.

In a variant, the end of the applicator element can be constituted by a fitted part.

The greatest transverse dimension of the applicator element preferably lies in the range 2 mm to 6 mm, and more preferably is about 3 mm.

FIG. 18 shows flocking using a mixture of fibers comprising fibers 45 and 46 of different lengths.

The invention also provides an applicator for a makeup device as defined above.

BRIEF DESCRIPTION OF THE DRAWINGS

Other characteristics and advantages of the present invention will appear on reading the following detailed description of a non-limiting embodiment of the invention, and on examining the accompanying drawings, in which:

FIGS. 14 and 15 show two variant embodiments of the free end of the applicator;

FIG. 16 is a fragmentary and diagrammatic view in perspective of an applicator constituting a fifth embodiment of the invention;

FIG. 17 is a diagrammatic view showing a makeup device of the invention;

DETAILED DESCRIPTION OF PREFERRED EMBODIMENTS

Figure 1:
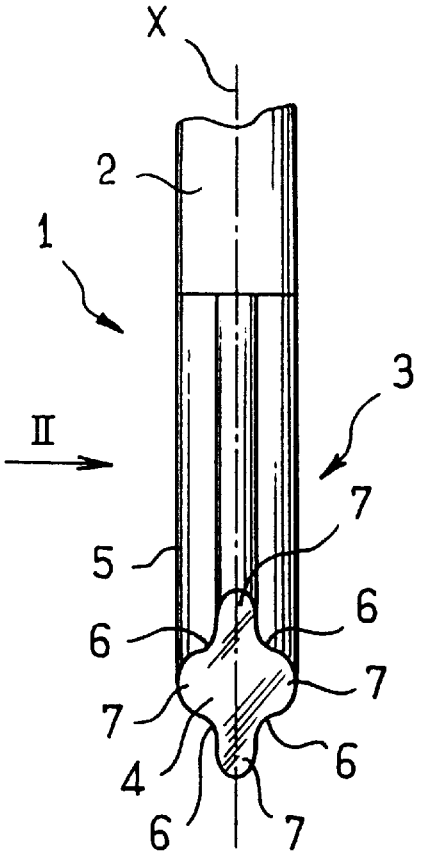
FIG. 1 is a fragmentary and diagrammatic view in elevation of an applicator constituting a first embodiment of the invention.
Figure 2:
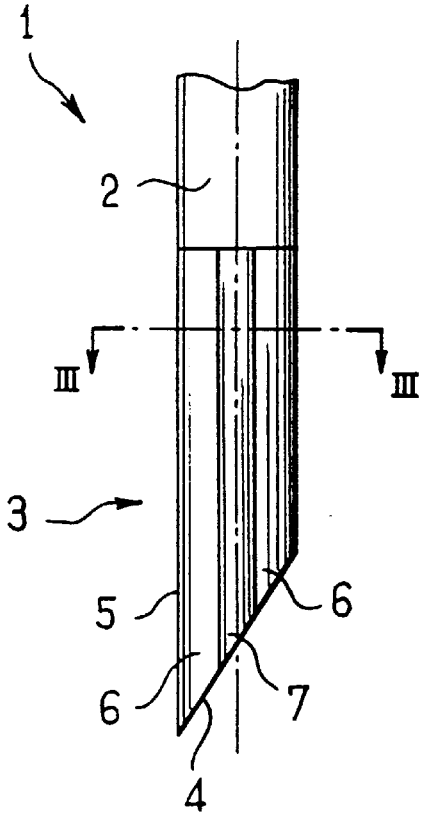
FIG. 2 is a side view as seen on arrow II of FIG. 1.

The applicator 1 shown in part in FIGS. 1 to 4 comprises a stalk 2 having one end connected to a conventional handle element (not shown).

The other end of the stalk 2 is extended by an applicator element 3 whose free end 4 forms a chamfer.

The plane of the chamfer is inclined by 30° to the longitudinal axis X of the stalk 2.

The side surface 5 of the applicator element 3 is cylindrical about the axis X but it is not circularly cylindrical, in that it has depressions 6, there being four depressions in the example described.

The depressions 6 are uniformly distributed around the axis X, and extend longitudinally over the entire length of the side surface 5, opening out to the free end 4, and they are separated from one another by ribs 7 whose ridges are outwardly convex.

Figure 3:
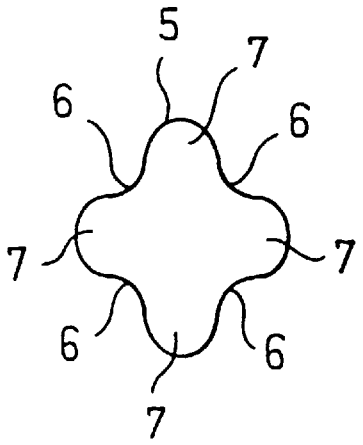
FIG. 3 is a view on section line III—III of FIG. 2.

In cross-section, the outline of the side surface 5 presents four lobes, with the bottoms of the depressions 6 being concave towards the outside, as can be seen in FIG. 3.

The applicator 1 is designed to be received, when not in use, in a container R of the kind shown diagrammatically in FIG. 17, which container is provided with a wiper member E constituted by an annular lip.

The radially inner edge of the wiper member is circumscribed about the ridges of the ribs 7.

Figure 18:
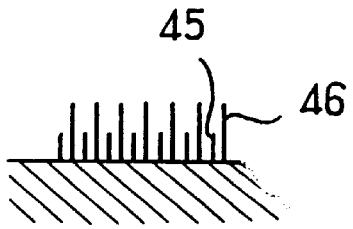
FIG. 18 shows flocking using a mixture of fibers.

The applicator element 3 is made, for example, by injection molding an elastomer material, and it is coated on its surface with flocking, which flocking can be constituted by a mixture of fibers 45 and 46 of different lengths, as shown very diagrammatically in FIG. 18.

Figure 4:
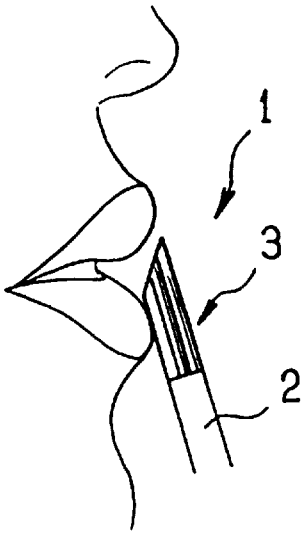
FIG. 4 shows the applicator in use for making up the lips.

To use the applicator 1, the user draws the outline of the lips by means of the leading edge of the free end 4 in conventional manner, for example, and then moves the side surface 5 in a direction that is substantially perpendicular to the axis X, as shown in FIG. 4.

The cosmetic contained in the depressions 6 and that has escaped being wiped off, is then deposited on the lips.

In addition, the presence of the depressions 6 makes it possible to reduce or even eliminate the above-mentioned "pistoning" phenomenon by preventing any suction being created within the container while the applicator is being withdrawn therefore.

Thus, the quantity of cosmetic deposited on the free end 4 is relatively constant and uniform from one application to another.

Figure 5:
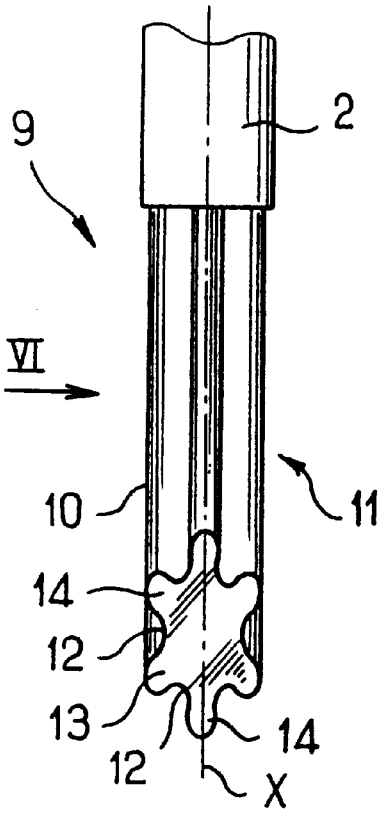
FIG. 5 is a fragmentary and diagrammatic view in elevation of an applicator constituting a second embodiment of the invention.
Figure 6:
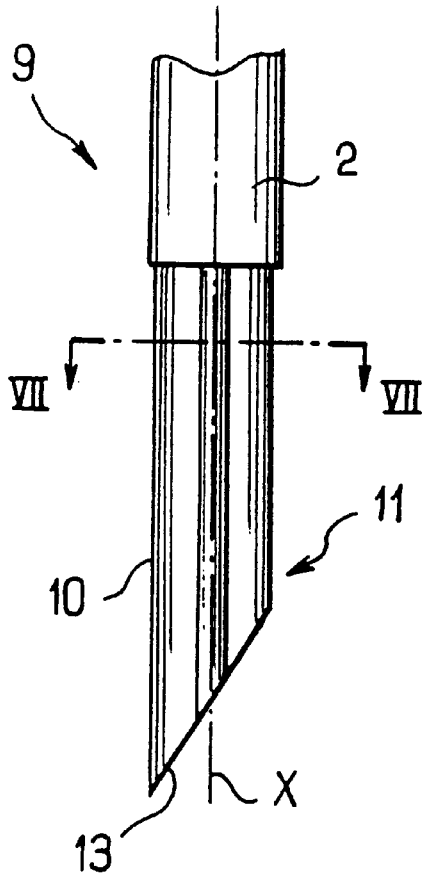
FIG. 6 is a side view looking along arrow VI of FIG. 5.
Figure 7:
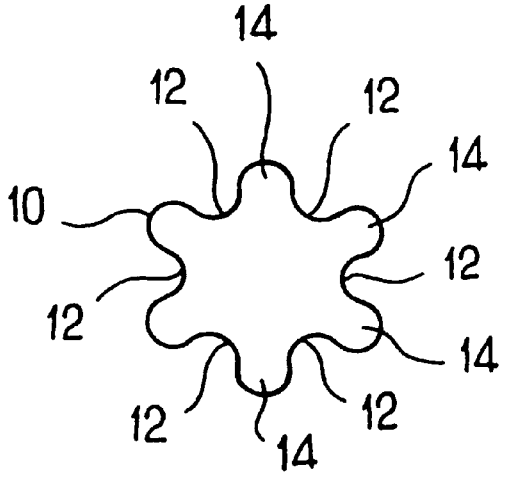
FIG. 7 is a view on section line VII—VII of FIG. 6.

FIGS. 5 to 7 show an applicator 9 which differs from the above-mentioned applicator in the number of depressions 12 formed in the side surface 10 of the applicator element 11.

More particularly, the applicator 9 in this case has six depressions 12 opening out to the chamfered end 13 and separated from one another by ribs 14.

As in the preceding embodiment, the depressions 12 are distributed around the longitudinal axis X in axial symmetry.

In cross-section, the applicator element 11 is generally oblong in shape, having six lobes, with the ridges of the ribs 14 being circumscribed by a curve that is substantially elliptical with its major axis being contained in the plane including the longitudinal axis X and the leading edge of the chamfered end 13.

The applicator is used as described above with reference to FIG. 4, the presence of the depressions 12 making it possible to use the side surface 10 for makeup purposes and also to eliminate the pistoning phenomenon.

Figure 8:
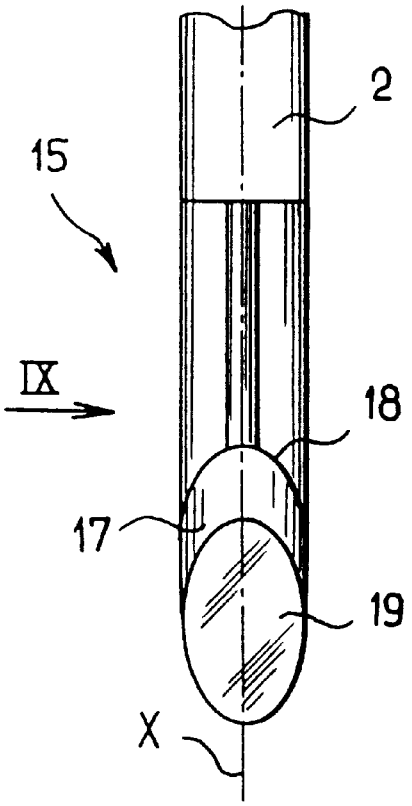
FIG. 8 is a fragmentary and diagrammatic view in elevation of an applicator constituting a third embodiment of the invention.
Figure 9:
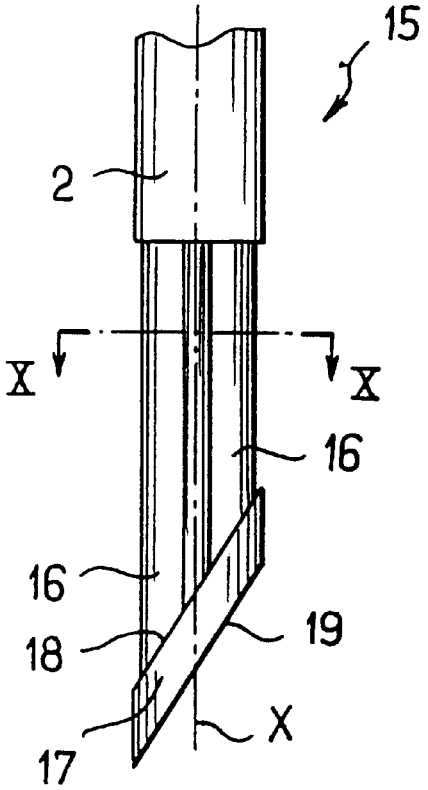
FIG. 9 is a side view looking along arrow IX of FIG. 8.
Figure 10:
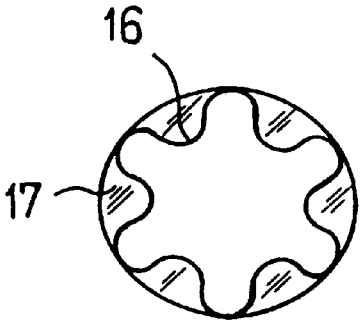
FIG. 10 is a view on section line X—X of FIG. 9.

FIG. 8 shows an applicator 15 which differs from the applicator described with reference to FIGS. 5 to 7 by the fact that the depressions, now referenced 16, do not open out to the free end of the applicator element, but terminate at a distance therefrom so as to leave a circularly cylindrical portion 17 about the axis X, which portion is axially defined at the end of the stalk 2 by a plane surface 18 parallel to the chamfered end 19.

The thickness of this cylindrical portion 17 is small enough to avoid giving rise to the problem of pistoning while the applicator is being withdrawn.

The presence of the portion 17 makes it possible to avoid the cosmetic contained in the depressions 16 running over the chamfered end 19.

Figure 11:
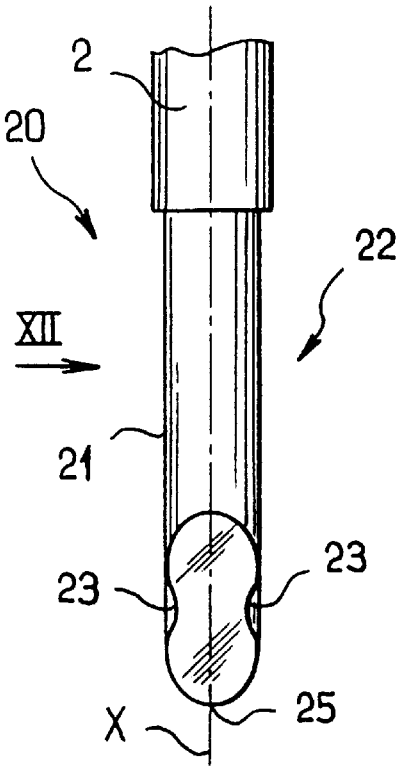
FIG. 11 is a fragmentary and diagrammatic view in elevation of an applicator constituting a fourth embodiment of the invention.
Figure 12:
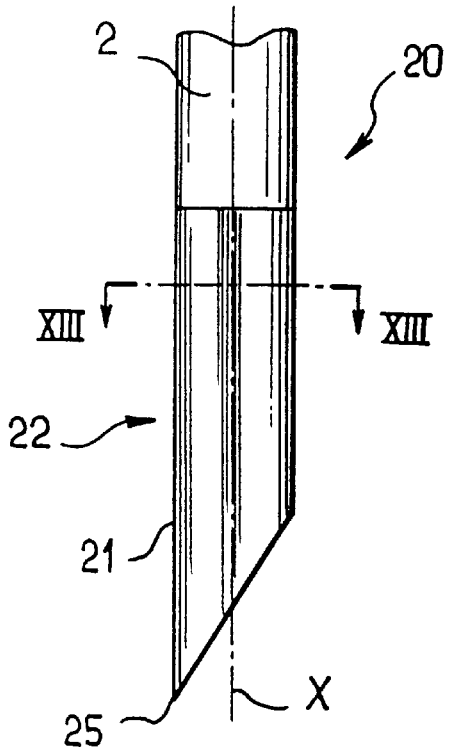
FIG. 12 is a side view seen along arrow XII of FIG. 11.
Figure 13:
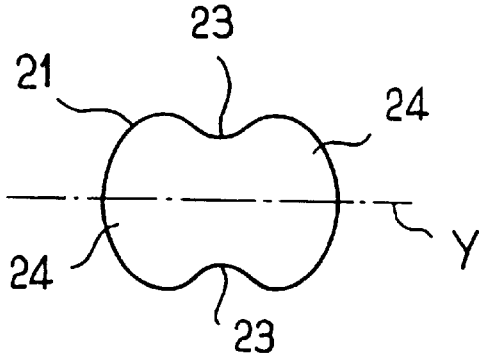
FIG. 13 is a view on section line XIII—XIII of FIG. 12.

The applicator 20 shown in FIGS. 11 to 13 has two diametrically opposite depressions 23 extending over the entire length of the side surface 21 of the applicator element 22.

In cross-section, the applicator element 22 has two lobes whose ridges are circumscribed by a substantially elliptical curve of major axis Y contained in a median plane of symmetry including the leading edge of the chamfered end 19.

In cross-section, the ribs 24 formed on either side of the depressions 23 presents an outline that is substantially semi-elliptical, curving towards its ends to run into the depressions 23 without discontinuity.

It may be observed that the relatively large open width of the depressions 23 and the relatively shallow depth thereof enables the skin to reach the bottoms thereof when sufficient pressure is exerted, thus making it possible to use all of the cosmetic contained within the depressions 23 for makeup purposes, thereby enabling the applicator to be used for a long time between refills.

The chamfered end of the applicator element can be plane, as is the case in the embodiments described above, slightly concave towards the outside as shown in FIG. 14, or in a variant slightly convex towards the outside, as shown in FIG. 15.

Without going beyond the ambit of the present invention, the free end of the applicator element could also be conical or frustoconical or have any other appropriate shape suitable for applying makeup precisely, for drawing the outline of the lips or of the eyelids.

FIG. 16 shows an embodiment in which the applicator element has a pointed end portion 40 which is connected to the stalk 2 of the applicator.

A sleeve 42 is fitted onto the stalk 2, extending the end portion 40.

On its radially outer surface, constituting the side surface of the applicator element, the sleeve 42 has depressions 43 which are in the form of longitudinal stripes, as shown in FIG. 16.

The fact of using a fitted part, i.e. the sleeve 42 in the embodiment described, for the purpose of making the side surface of the applicator element, makes it easier to provide a particular surface appearance, given that this part is made separately.

In particular, it is possible to make the sleeve out of a material that is more flexible or that is harder than the end portion, depending on the desired effect.

Figure 19:
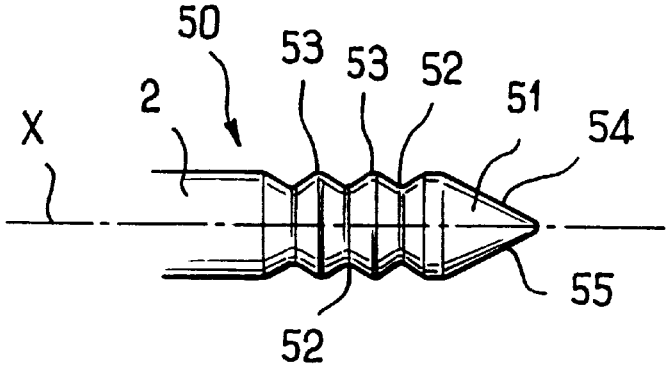
FIG. 19 is a fragmentary and diagrammatic view in elevation of an applicator constituting a sixth embodiment of the invention.

FIG. 19 shows an applicator 50 whose side surface has ring-shaped depressions 52.

The ridges 53 between the ring-shaped depressions 52 are preferably rounded, as shown in FIG. 19.

The end 51 of the applicator has two chamfers 54 and 55.

Figure 20:
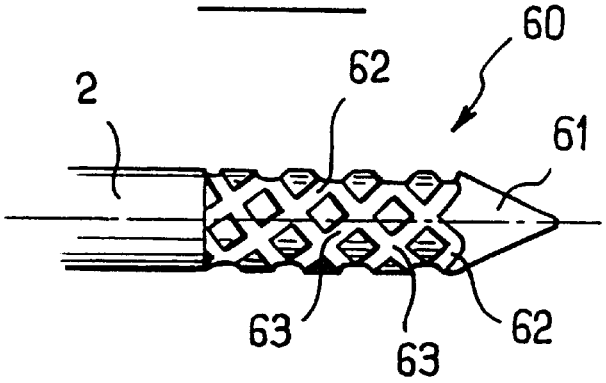
FIG. 20 is a fragmentary and diagrammatic view in elevation of an applicator constituting a seventh embodiment of the invention.

The applicator element of the applicator 60 as shown in FIG. 20 has a side surface in which two helical grooves 62 and 63 are formed that cross each other.

The end 61 of the applicator element has two chamfers.

Figure 21:
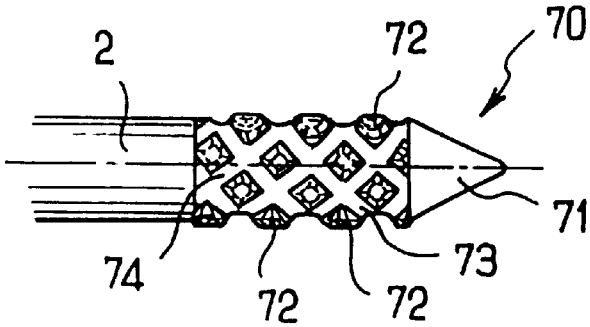
FIG. 21 is a fragmentary and diagrammatic view in elevation of an applicator constituting an eighth embodiment of the invention.

FIG. 21 shows an applicator 70 in which the outside surface of the applicator element has a crisscross configuration of helical grooves 73 and 74 leaving between them portions in relief 72 that constitute diamond-shaped tips.

The end 71 of the applicator element is in the form of two chamfers.

Naturally, it would not go beyond the ambit of the presents invention to provide various modifications to the embodiments described above, with the features of the various embodiments described being suitable for being combined with one another.

What is claimed is:

1. A device for making up the lips or the eyelids, the device comprising a container containing the cosmetic to be applied, an applicator including an applicator element, and a wiper member through which the applicator element is extracted from the container, wherein, at least while the applicator element is passing through the wiper member, the applicator element and the wiper member present sections that are different so that the wiper member does not come into wiping contact with all of the side surface of the applicator element, and some cosmetic remains thereon after the applicator element has passed through the wiper member.

2. A device according to claim 1, wherein the side surface of the applicator element is a cylinder having a non-circular cross-section.

3. A device according to claim 1, wherein the wiper member is constituted by an annular lip whose radially inner edge is circular.

4. A device according to claim 3, wherein the side surface of the applicator element presents in cross-section an outline that includes lobes whose ridges are circumscribed by the radially inner edge of the wiper member.

5. A device according to claim 1, wherein the wiper member comprises a block of foam.

6. A device according to claim 1, wherein the side surface of the applicator element has at least one depression.

7. A device according to claim 6, wherein said depression is relatively shallow, its depth not exceeding one-fourth the outside diameter of the applicator element.

8. A device according to claim 1, wherein the general shape of the free end of the applicator element is obtained by molding a plastics material.

9. A device according to claim 1, wherein the free end of the applicator element is in the form of a point or a chamfer.

10. A device according to claim 1, wherein the side surface of the applicator element includes a plurality of longitudinally-extending depressions.

11. A device according to claim 1, wherein the side surface of the applicator element includes a crisscross configuration.

12. A device according to claim 1, wherein the side surface of the applicator element includes ring-shaped depressions.

13. A device according to claim 1, wherein the side surface of the applicator element includes at least one depression opening out to its free end.

14. A device according to claim 1, wherein the side surface of the applicator element includes at least one depression terminating at a distance from its free end.

15. A device according to claim 1, wherein the side surface of the applicator element includes a plurality of depressions separated by longitudinally-extending ribs.

16. A device according to claim 1, wherein the side surface of the applicator element includes at least one depression presenting in cross-section a profile that is rounded and outwardly concave.

17. A device according to claim 1, wherein the side surface of the applicator element includes a plurality of depressions, disposed in such a manner as to preserve axial symmetry.

18. A device according to claim 1, wherein the free end of the applicator element is chamfered in shape.

19. A device according to claim 18, wherein the side surface of the applicator element includes at least two depressions separated by at least two ribs whose ridges lie in a plane containing the longitudinal axis of the applicator and the leading edge of the free end of the applicator element.

20. A device according to claim 1, wherein the side surface of the applicator element includes at least one depression made in a fitted part, which part is preferably constituted by a sleeve.

21. A device according to claim 1, wherein the largest transverse dimension of the applicator element lies in the range 2 mm to 6 mm.

22. A device according to claim 1, wherein the side surface of the applicator element is flocked.

23. A device according to claim 22, wherein the side surface of the applicator element is flocked with a mixture of fibers.

24. An applicator for a makeup device as defined in claim 1.

25. A method for making up the lips or eyelids comprising an applicator for applying a cosmetic from the device of claim 1.

26. A device according to claim 14, wherein said distance is at least 1 mm.

27. A device according to claim 15, wherein said ribs present in cross-section a profile that is rounded and outwardly convex.

28. A device according to claim 17, wherein the side surface includes two, four or six said depressions.

29. A device according to claim 18, wherein the free end makes an angle lying in the range 15° to 45° with the longitudinal axis of the applicator.

30. A device according to claim 21, wherein the transverse dimension of the applicator element lies in the range 2 mm to 6 mm.

31. A device for making-up the lips or the eyelids, the device comprising a container containing the cosmetic to be applied, an applicator including an applicator element, and a wiper member through which the applicator element is extracted from the container, wherein, at least while the applicator element is passing through the wiper member, the applicator element and the wiper member present sections that are different, so that the wiper member does not come into wiping contact with all of the side surface of the applicator element, and some cosmetic remains thereon after the applicator element has passed through the wiper member, wherein the applicator member has depressions and wherein all said depressions are shallow, their depth enabling the skin to reach the bottom thereof when sufficient pressure is exerted.

32. A device for making up the lids or the eyelids, the device comprising a container containing the cosmetic to be applied, an applicator including an applicator element, and a wiper member through which the applicator element is extracted from the container, wherein, at least while the applicator element is passing through the wiper member, the applicator element and wiper member present sections that are different so that wiper member does not come into wiping contact with all of the side surface of the applicator element, and some cosmetic remains thereon after the applicator element has passed through the wiper member, wherein said applicator element has no annular grooves.

* * * * *